United States Patent [19]

Komaransky et al.

[11] Patent Number: 4,699,609

[45] Date of Patent: Oct. 13, 1987

[54] ELECTRIC CUTTER MECHANISM FOR DUNNAGE CONVERTER

[75] Inventors: Anthony J. Komaransky, Mentor; Henry L. Meyer, Cleveland Heights, both of Ohio

[73] Assignee: Ranpak Corp., Willoughby, Ohio

[21] Appl. No.: 832,985

[22] Filed: Feb. 25, 1986

[51] Int. Cl.[4] ..... B05B 1/14

[52] U.S. Cl. ..... 493/357; 493/462; 493/464; 493/967; 83/222; 83/575

[58] Field of Search ..... 493/357, 462, 464, 967; 83/575, 604–609, 203, 205, 222

[56] References Cited

U.S. PATENT DOCUMENTS

| | | | |
|---|---|---|---|
| 1,333,940 | 3/1920 | Seymour | 83/605 |
| 1,958,132 | 5/1934 | Davis | 83/575 |
| 2,101,170 | 12/1937 | Stern | 83/607 |
| 2,860,703 | 11/1958 | O'Donnell | 83/575 |
| 3,695,133 | 10/1972 | Finke | 83/222 |
| 3,735,445 | 5/1973 | Jurcak | 83/607 |
| 4,026,198 | 5/1977 | Ottaviano | 493/357 |
| 4,198,888 | 4/1980 | Gatt | 83/607 |

*Primary Examiner*—Frederick R. Schmidt
*Assistant Examiner*—Robert Showalter
*Attorney, Agent, or Firm*—Baldwin, Egan, Hudak, & Fetzer

[57] ABSTRACT

A converter mechanism for producing generally low density pad-like cushioning dunnage product in continuous strip form from flexible sheet-like stock material such as, for instance, paper, with an electrically energizable cutter mounted on the converter mechanism, for cutting the produced dunnage product into selected lengths. The cutter includes a pivotably movable blade member adapted for engaging the produced strip of dunnage product and severing it to selected length, together with an electrically energizable motor unit coupled to the cutter blade member for actuating the latter pursuant to control of the mechanism operator.

13 Claims, 15 Drawing Figures

ELECTRIC CUTTER MECHANISM FOR DUNNAGE CONVERTER

This invention relates in general to a converter mechanism for producing low density pad-like cushioning dunnage product in strip form from flexible sheet-like stock material, and more particularly to a converter mechanism having thereon a cutter means including a movable cutter blade member adapted for severing the produced dunnage product into selected lengths, with the cutter means being electrically powered.

BACKGROUND OF THE INVENTION

Dunnage producing mechanism for producing a resilient pad-like cushioning dunnage product having lateral pillow-like resilient portions connected together by a lengthwise extending central portion, such as for instance a coined section, are known in the art.

U.S. Pat. No. 4,026,198 to Ottaviano dated May 31, 1977 and entitled Cushioning Dunnage Mechanism, Transfer Cart Therefor and Method, discloses a cushioning dunnage producing mechanism of the general type shown as used in connection with the present invention, and which includes a cutter mechanism therewith selectively actuatable by a workman, for cutting the produced strip of pad-like dunnage product into selected lengths.

Such prior art cutter mechanism conventionally comprises an air actuated motor unit which moves a cutter blade mounted on rollers mounted in guiding tracks, relative to the produced dunnage product, to cause transverse severing of the resilient pad-like product into selected lengths.

The prior art converter mechanism per se are generally actuated or powered by an electric drive motor connected to a speed reducer which in turn is operatively connected to one of a pair of coacting gear-like members of the connecting section of the mechanism, for causing rotation of the gear-like members of the connecting section, to perform a coining or connecting operation on the laterally oriented pillow-like portions of the formed stock material, by rotation of the gear-like members as the rolled edge stock material is pulled through the connecting section of the converter mechanism by such electrically powered rotating connecting gear-like members.

Energization of the electric drive motor of the converter mechanism thus not only actuates the connecting mechanism thereof, but also provides for movement of the sheet-like stock material through the machine for formation of the pad-like dunnage product and movement of the latter out the exit end of the converter mechanism, in the production of the pad-like dunnage product by the converter mechanism.

In the past, the cutter mechanism which must be able to shear rapidly and thoroughly through the produced, relatively resilient pad-like cushioning dunnage product in order to expeditiously cut the produced product into the desired lengths, in the process of utilizing the product as packing, has conventionally been actuated or energized by means of a reciprocal type pneumatic motor, with such motor being energized by means of workman operated finger switches on the converter mechanism, to cause operation of an associated solenoid valve, permitting pressurized air to enter the reciprocal air powered motor unit and thus actuate the latter and initiate the severing operation on the produced dunnage product. This need for a source or pressurized air to operate the cutter of the prior art converter mechanisms has sometimes limited the use of the prior art converters in that some commercial and/or manufacturing installations do not possess a source of pressurized air, and thus power cutting of the produced strip of cushioning dunnage pad-like product was not possible, and either the machine could not be used at such locations, or manual severing of the pad-like product emitted from the machine had to be resorted to. Manual severing is not satisfactory because among other factors it is extremely time consuming, and generally disrupts the structure of the formed pad-like product.

SUMMARY OF THE INVENTION

The present invention provides a novel electrically powered cutter mechanism for use with an electrically driven dunnage producing machine, enabling the generally resilient pad-like dunnage product being emitted from the machine to be effectively and rapidly severed into selected lengths, while standardizing the power needed to operate the machine, or in other words, enabling the machine to be used where only electrical power is available.

Accordingly, an object of the invention is to provide a novel machine for producing strip form cushioning dunnage for use as packing material and one wherein the cutting mechanism on the machine for selectively cutting the produced strip of pad-like cushioning dunnage product into desired lenghts is electrically powered, the same as the other operating components of the machine.

Another object of the invention is to provide a machine of the aforementioned type wherein the cutter means includes a movable blade member adapted for pivoting in a generally vertical plane for accomplishing shearing of the produced pad-like dunnage product into selected lengths, and wherein the power unit for the cutting mechanism comprises an electric solenoid.

A still further object of the invention is to provide a machine of the latter described type including adjustable stop means providing for selective adjustment of the range of movement of the cutter blade of the cutter mechanism.

A still further object of the invention is to provide a machine of the aforementioned type wherein the cutter mechanism includes an inverted generally U-shaped bracket disposed in partially encompassing relationship to the product exit opening of the machine, with a generally linear cutter blade mounted on the inverted bracket and adapted for cutting coaction with an arcuate pivotally mounted cutter blade, coupled to the aforementioned solenoid and wherein the solenoid can be actuated by means of machine mounted finger switches under the control of the machine operator.

Other objects and advantages of the invention will be apparent from the following description taken in conjunction with the accompanying drawings wherein:

DESCRIPTION OF PREFERRED EMBODIMENT

Figure 1:
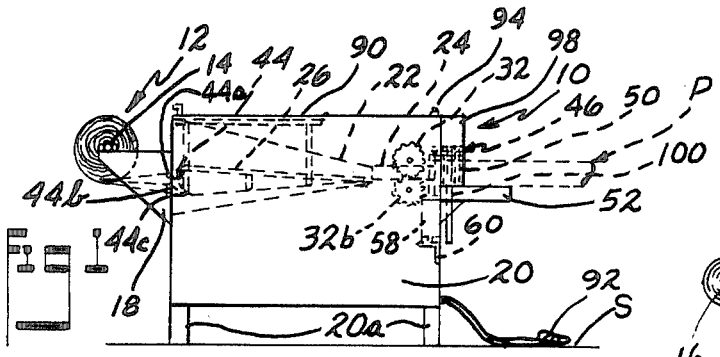
FIG. 1 is a side elevational view of a converter mechanism embodying an electrically powered cutter mechanism embodying the invention.

Referring now again to the drawings, there is illustrated a dunnage producing machine 10 which utilizes a multi-ply stock roll 12 of sheet-like stock material such as, for instance, 30 pound kraft paper sheet. In the embodiment of stock roll illustrated in, for instance, FIGS. 1 and 2, the plies of the stock roll are preferably of equal width and in the embodiment illustrated comprise three plies disposed in roll form, for expeditious and compact installation on the dunnage producing machine.

Stock roll 12 in the embodiment illustrated, comprises a hollow core 14 of generally cylindrical configuration on which the three super-imposed webs or sheets of stock material are wound. The stock roll is adapted to be mounted on a supporting rod 16 extending relatively loosely through the core 14, for rotation of the stock roll 12 relative to the supporting frame structure 18 as the stock is drawn from the roll into the dunnage machine 10.

Reference may be had to aforementioned U.S. Pat. No. 4,026,198 which is incorporated herein by reference, for a more detailed explanation of the mounting of the stock roll on the converter. It will also be understood that the stock roll may be mounted on a separate stand or cart and the plies therein fed into the converter in a manner known in the art.

Machine 10 in the embodiment illustrated, comprises an enclosed or sheathed support framework 20 including leg portions 20*a*, which may include means (now shown) associated therewith for leveling the support framework with respect to the supporting surface S.

Framework 20 supports a longitudinally converging chute-like member 22 (FIGS. 1 and 2) which chute forms a guide and support for the webs or plies of stock material as they are drawn off the stock roll 12 and are passed to longitudinally elongated crumpler section 24 of the dunnage producing machine. In the embodiment illustrated, the chute 22 and crumpler section 24 may be provided as an integral unit which can be conveniently formed, for instance, of plastic or other suitable moldable material.

Figure 3:
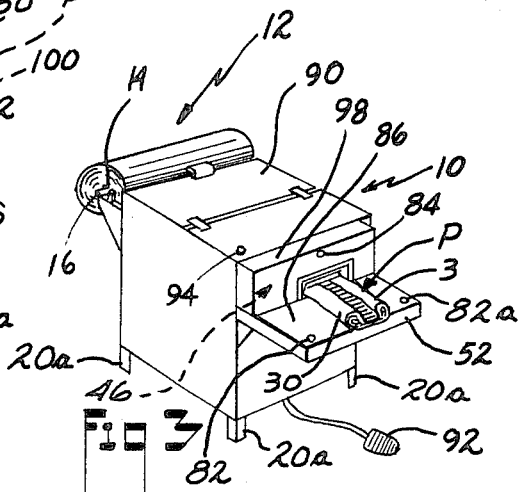
FIG. 3 is a perspective, rear end view of the converter mechanism of FIGS. 1 and 2.
Figure 2:
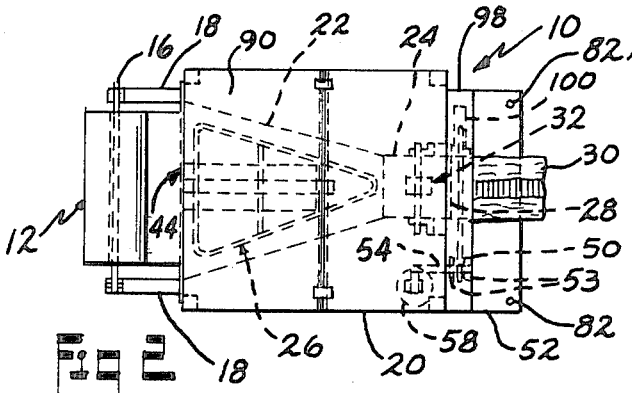
FIG. 2 is a top plan view of the FIG. 1 mechanism.

A pusher or stock forming mechanism 26 which in the embodiment illustrated comprises a tubular body portion of generally triangular shape in plan, is supported in the chute in relatively closely spaced relation to the bottom interior surface thereof, and against which the webs or sheet-like stock material are adapted to move or slide during movement from the stock roll to the crumpler section 24, and thence exiting from the product exit opening 28 of the machine in the form of the resilient pad-like dunnage product P shown in FIGS. 2 and 3. Reference may be had to copending U.S. patent application Ser. No. 609,001 filed May 10, 1984 in the name of Gary W. Ottaviano, and entitled Mechanism and Method For Producing Cushioning Dunnage for a detailed disclosure of a converter mechanism, including pusher or forming mechanism of the general type shown in FIGS. 1 and 2, and the operation thereof.

As the sheet-like stock material is passed from the stock roll through the chute 22, the side edges of the stock webs are rolled inwardly into generally spiral form and are urged inwardly toward one another so that the inwardly rolled edges form resilient pillow-like portions 30 (FIGS. 2 and 3) of stock material disposed in generally abutting relationship as they emerge from the exit end of the chute member and pass into the crumpler section 24 where they are adapted to be joined together by connecting mechanism 32.

Connecting mechanism 32 in the embodiment illustrated, comprises generally loosely meshed, vertically oriented gears 32*a*, 32*b* (FIG. 6) which are rotatably mounted as by means of a respective shaft, with the shaft of the upper gear 32*a* preferably being so arranged that each end of the shaft is mounted in a respective slotted bracket 34 and with such shaft ends being spring loaded as at 36, for urging the shaft of upper gear 32*a* downwardly toward the underlying gear member 32*b*. It will be seen therefore that the upper gear 32*a* of the connecting section of the converter, which is rotatable relative to its spring loaded supporting shaft, generally floats due to the supporting slotted bracket structure 34, with the gear 32*a* being movable vertically relative to the underlying gear and thus providing for automatic varying of the space between the gear teeth in the event of different thickness or amounts of the sheet-like stock material passing therebetween. Such an arrangement aids in preventing tearing of the stock material due to too hard meshing between the connecting gearing mechanism of the converter.

The underlying connector gear 32b is keyed or otherwise secured to its shaft, with the latter in the embodiment illustrated, being rotatably mounted at its ends in bearing structure, and which may include a sprocket secured at one end of the lower gear shaft and which sprocket is connected as shown, by an endless chain or belt to a gear speed reducer 40, the latter being driven by a preferably reversible electric motor 42 mounted on the machine frame 20.

Mounted on the converter framework just downstream from the stock roll is a separating means 44 (FIGS. 1 and 2). In the embodiment illustrated, the separating means 44 comprises a plurality of vertically spaced bar-like elements 44a, 44b and 44c about which is adapted to pass the individual webs or plies of stock material from the stock roll and maintain the webs in separated condition prior to their being urged back into generally juxtaposed condition at the pusher or former mechanism 26, the latter being disposed downstream from the separator section 44.

The lateral edges of the webs coming off the stock roll after they pass the transversely extending separating rods 44a, 44b and 44c commence to be turned inwardly by the curved walls of the chute, and when the rolled edges of the webs reach the crumpler section, they have been rolled inwardly into generally abutting confronting relation with one another, and then the web stock material is crumpled generally radially inwardly by the crumpler section and is coined or joined together along the central portion thereof lengthwise of the produced pad-like stock product by the aforementioned meshed gear section 32.

After passing through the exit opening 28 of the converter, the continuously formed pad-like product P is adapted to be severed by cutter mechanism 46 mounted on the converter machine adjacent the exit opening 28, to cut the strip of produced dunnage product into the desired lengths.

Figure 4:
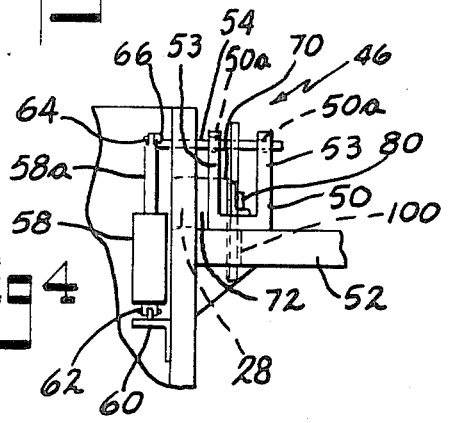
FIG. 4 is a fragmentary and elevational view of the cutter mechanism of the invention showing the mounting of the electrically powered solenoid and its connection to the rotatable shaft of the swinging blade portion of the cutter mechanism; the cover for the cutter mechanism has been deleted for the FIG. 4 showing.
Figure 5:
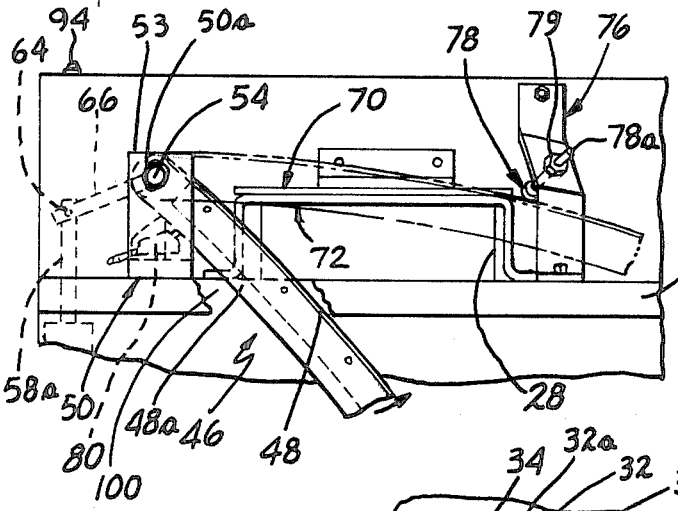
FIG. 5 is an enlarged elevational view of the cutter mechanism including the pivotal blade thereof and the inverted U-shape extender bracket mounted at the product exit opening of the converter machine, for mounting the linearly extending blade of the cutter mechanism, and which is adapted to coact in shearing relationship with the pivotal cutter blade, for cutting or shearing the produced pad-like dunnage product into selected lengths.
Figure 6:
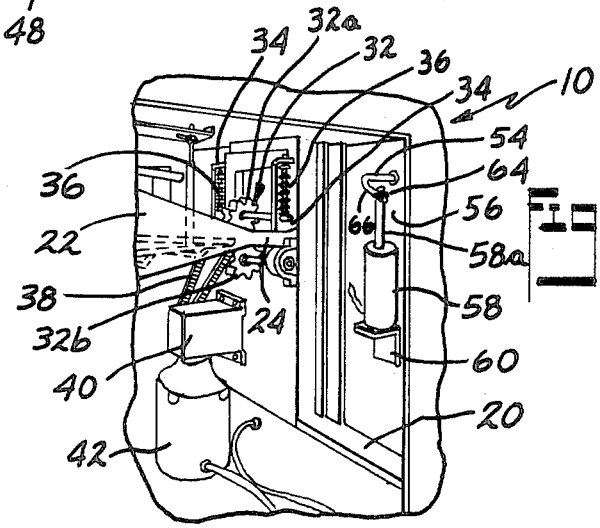
FIG. 6 is a fragmentary, generally perspective illustration of the interior of the converter mechanism showing the mounting of the solenoid power unit in the interior of the machine on the rear wall thereof, and which solenoid is adapted to actuate the cutter mechanism.
Figure 11:
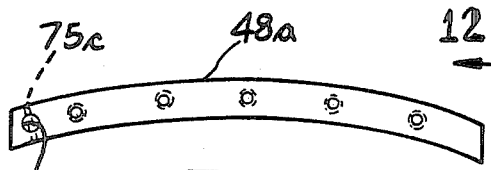
FIG. 11 is an elevational view of the blade mounting bar member of the cutter mechanism, and which is adapted for receiving in connected relation the rotatable actuating shaft of the cutter.

Cutter mechanism 46 comprises a pivotal cutter blade 48 (FIG. 5) attached to a mounting bar member 48a (FIG. 11) which is pivoted to a U-shape (in end elevation—FIG. 4) bracket 50 mounted exteriorly of the exit opening 28 of the machine and on cantilevered platform 52 of the machine. Bracket 50 preferably includes bearings 50a in the upstanding arms 53 thereof, which mount a rotatable shaft 54 thereon, with the shaft 54 extending through the back panel 56 of the machine and into the interior thereof, as best shown in FIG. 6.

Figure 14:
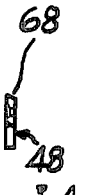
FIG. 14 is an end view of the cutter blade of FIG. 13 taken generally along the plane of line 14—14 of FIG. 13 looking in the direction of the arrows.
Figure 12:
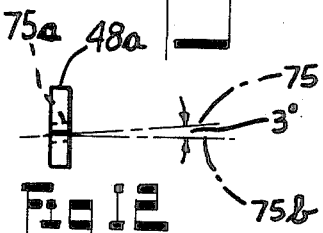
FIG. 12 is an end view of the mounting bar of FIG. 11 taken generally along the plane of line 12—12 of FIG. 11 looking in the direction of the arrows.

Electric solenoid 58 may be mounted on inverted L-bracket 60 secured to the interior side of panel 56, preferably in pivotal relation to bracket 60, utilizing clevis connection 62. Solenoid 58 is preferably a single acting spring loaded solenoid, with the plunger 58a thereof being movably coupled as at 64 to the distal end of a lever 66 (FIG. 6) which in turn is fixed to the aforementioned shaft 54 so that upon inward or retracting movement of the plunger 58a of solenoid 58, the shaft 54 is caused to rotate on its bearing structure 50a and with respect to its support bracket 50. Since the cutter blade 48 is fixed to the rotatable shaft 54, upon inward movement of the plunger of the soleniod, the cutter blade 48 and associated mounting bar 48a are caused to pivot upwardly, thereby moving the cutting edge 68 (FIG. 14) thereof upwardly into coacting cutting relationship with linear cutting blade 70 which is removably secured to inverted U-shaped bracket 72 which generally encompasses product exit opening 28 in the converter. Mounting bar 48a as can be best seen from FIGS. 11 and 12, preferably has the axis 75 of the opening 75a therethrough slightly tilted (at an angle of about 3°) with respect to the horizontal transverse plane 75b passing through the center point X of opening 75a in mounting bar 48a, to give a slight inward tilt to the mounting bar 48a and associated cutting blade 48 with respect to stationary blade 70, when mounting bar 48a is mounted on shaft 54. Threaded openings 75c are adapted to receive set screws (not shown) to removably attach mounting bar 48a to shaft 54.

Figure 7:
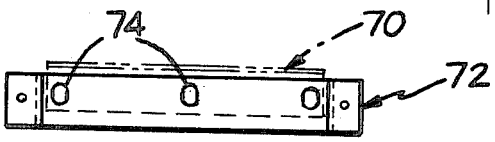
FIG. 7 is a bottom plan view of the inverted U-shaped extender bracket used for mounting the linear cutter blade thereon, the latter being shown in phantom lines.
Figure 8:
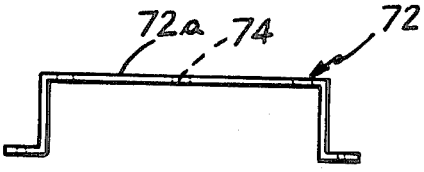
FIG. 8 is an elevational view of the bracket of FIG. 7.
Figure 9:
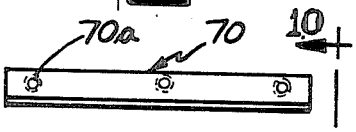
FIG. 9 is a top plan of the linear cutting blade for use with the bracket of FIGS. 7 and 8.
Figure 10:
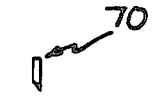
FIG. 10 is an end elevational view of the FIG. 9 blade taken generally along the plane of line 10—10 of FIG. 9 looking in the direction of the arrows.
Figure 13:
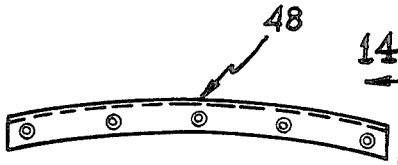
FIG. 13 is an elevational view of the arcuate cutter blade adapted for being mounted on the mounting bar of FIGS. 11 and 12.

As can be best seen from FIG. 7, the upper bridging leg 72a of bracket 72 has elongated openings 74 therein for providing for adjusting the position of the removable cutter blade 70 with respect to the bracket support, so that optimum cutting engagement can occur between the pivotal cutter blade 48 on support bar 48a and the stationary cutter blade 70 supported by bracket 72. Suitable threaded fasteners can be used extending through elongated openings 74 into threaded coaction with threaded openings 70a in blade 70 to secure the latter to bracket 72.

Secured to the exterior side of rear end panel 56 of the machine adjacent bracket 72 is a bumper bracket 76 (FIG. 5) which is adapted to support or position a bumper stop 78 thereon. As shown, for instance, in FIG. 5, the bumper stop 78 comprises a resilient, such as rubber, end and an elongated threaded stem 78a coacting in threaded relation with a threaded nut 79 secured to bracket 76, thus making the bumper stop adjustable with respect to the bracket 76. Bumper stop 78 is adapted to limit the upward pivotal movement of the swingable cutter blade and associated mounting bar 48a with respect to the stationary cutter blade 70. The bumper stop provides for the passage of the cutter blade 48 completely through the emitted strip of pad-like product, but adjustably limits its further movement.

In this connection, there is provided a spring loaded switch 80 FIGS. (4, 5 and 15) disposed in coacting relationship with the mounted end of the pivotal cutter blade 48 and mounting bar 48a, and adapted for opening or breaking the converter drive motor circuit upon upward pivotal swinging of the blade 48 and mounting bar 48a with respect to its supporting bracket 50 so that the power to the electric actuating motor 42 for actuating the converter mechanism in the pulling of the stock material through the machine, is terminated immediately upon application of power to the electric solenoid 58 for initiating the cutting operation. In other words, the strip of pad-like stock material being emitted from the machine is caused to be maintained stationary while the cutting operation is taking place, and upon deactuation of the electric cutter the solenoid 58 is deactuated and the spring-loaded plunger 58a thereof is caused to return to extended position and simultaneously gravity causes the mounting bar 48a and attached cutting blade 48 to return to the full line position shown in FIG. 5, thus causing reclosing of switch 80, to reinstate the circuit to converter drive motor 42.

Figure 15:
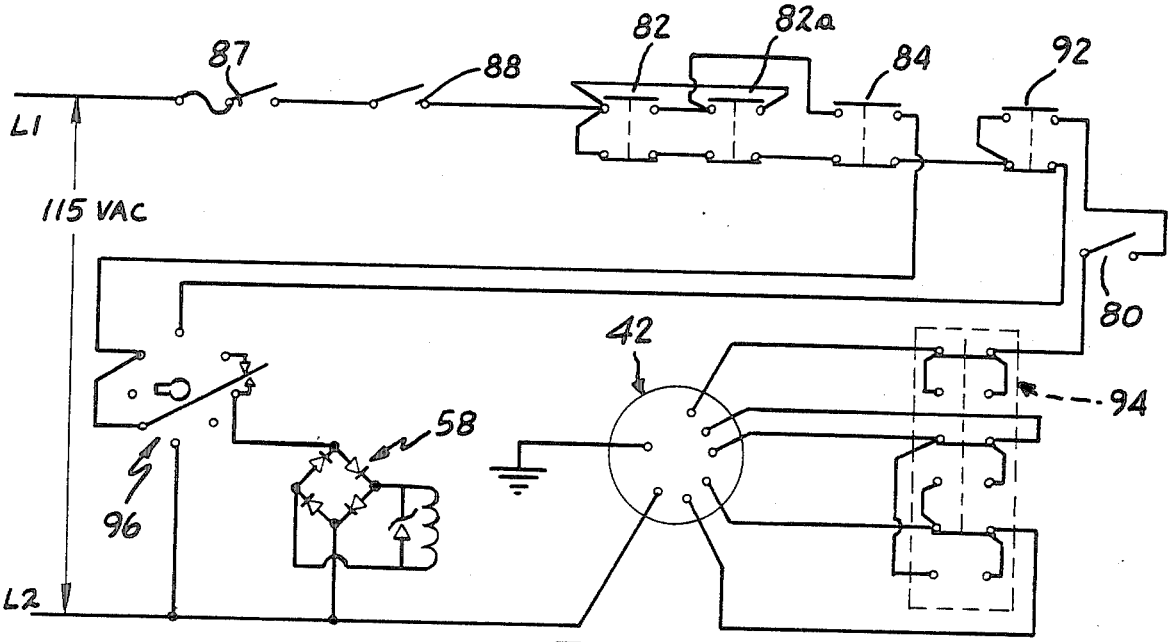
FIG. 15 is a schematic of the electric circuit for controlling operation of the all electrically powered converter.

Referring now in particular to FIG. 15, the solenoid unit 58 in the embodiment illustrated, is adapted to be controlled by the machine operator, in its energization, so as to cause pivotal movement of the cutter blade 48, by means of a pair of control button switches 82, 82a and 84. Switches 82, 82a are preferably mounted on opposite sides of the table surface 86, while control button switch 84 may be mounted above the exit opening for the product, as shown in FIG. 3.

The machine is adapted for being plugged into a conventional 115 volt A.C. source of electrical power, and includes manual on-off overload switch 87 and also preferably rear cover interlock switch 88 which ensures that the converter mechanism 10 is operable only if top access cover 90 (FIGS. 1–3) is in its "down" position, as illustrated.

The left and right manually actuated spring loaded switches 82, 82*a* provided on table surface 86 of the mechanism, together with common spring loaded button switch 84 located generally centrally of the framework 24 at the product exit end of the converter mechanism, provide for convenient manual actuation of the cutter device 46 by the operator. It will be seen that in order to actuate the solenoid 58 controlling the cutter blade 48, both the common cut button switch 84 and one or the other of the cut button switches 82, 82*a* must be actuated, which supplies current to the solenoid 58 to cause retraction of the plunger 58*a* thereof, and thus actuation of the cutter blade device 46, thereby accomplishing generally transverse severing of the produced dunnage product from the continuous strip thereof emitted from the machine. Having a cut button switch (e.g. 82, 82*a*) on both sides of the machine facilitates operation of the converter by a workman from either side of the converter mechanism.

Actuation of any of the cut button switches 82, 82*a* or 84 disconnects the reversible electric drive motor 42 which drives the connecting means 32 of the converter mechanism, thus further ensuring that the produced product will be stationary relative to the converter mechanism during the aforementioned severing operation.

In the embodiment illustrated, spring biased foot switch 92 is provided for furnishing a manual operator control for actuation of electric drive motor 42, and thus actuation of the converter mechanism. Actuation of the manual foot switch 92 by the machine operator causes energization of the drive motor 42, to cause the produced dunnage product to be emitted from the exit end of the converter mechanism. Release of the foot switch automatically disconnects the drive motor 42 from power, and causes the converter mechanism to stop emitting dunnage product if it is under manual control.

Motor 42 is preferably a reversible A.C. motor and includes manual reversing switch 94 (FIGS. 3, 5 and 15) for providing for reverse actuation of the electric motor 42, whereby the strip of produced dunnage product can be reversed in its direction of movement, and moved in the direction of the supply roll 12. Such an arrangement is convenient in the event of a need to remove a "jam" in the converter mechanism in the production of the pad-like dunnage product.

Referring now particularly to FIG. 15, anti-tie down and anti-repeat module 96 is provided in the control circuit for preventing immediate reenergization of the cutter mechanism 46 after completion of a cutting operation, and also preventing energization of the cutter mechanism if a machine operator attempts to by-pass the plural cutter button switch required by having some device mechanically hold one of the cutter button switches (e.g. common cutter switch 84) in its activated condition. For instance, if an operator would force a nail or wood splinter into any of the cutter button switches to hold it in activated condition, module 96 prevents energization of the cutter solenoid 58 and thus prevents energization of the cutter mechanism 46. The main or common cutter button switch 84 and one or other of the auxiliary cutter button switches 82, 82*a* thus have to be actuated within a couple of seconds of one another or else the solenoid 58 is inoperable. Likewise, both actuated cutter button switches have to be released before the solenoid can be actuated to initiate a subsequent cutting operation. Anti-tie down—anti-repeat module 96 is a commercially available item obtainable from Nolatron, Inc. of Harrisburg, Pa., and a suitable one has been found to be module identified as No. 3370.

The cutter mechanism 46, as can be best seen in FIG. 3, is preferably enclosed by a upper rectangular shaped removable or openable housing section 98 into which the cutter blade moves during its upward pivotal movement to sever the pad-like product being emitted from the machine. This helps to ensure that the workman will not inadvertently have his hand in an area where he could be injured by the pivotal blade upon energization of the cutter unit. As can be best seen in FIGS. 1, 2 and 5, the pivotal cutter blade 48 and cutter bar 48*a* in their reposed position extend downwardly through a slot 100 in table portion 52 and are movable through such slot into housing section 98.

From the foregoing description and accompanying drawings, it will be seen that the invention provides a converter mechanism for producing generally low density pad-like cushioning dunnage product in strip form from flexible sheet-like stock material, and embodying a novel cutter mechanism for cutting the dunnage product into selected lengths, with the cutter mechanism comprising an electrically energizable motor unit.

The invention also provides a cutter unit for use in connection with a machine produce pad-like cushioning dunnage product in strip form from sheet-like stock material such as, for instance, paper, with the cutter unit comprising a pivotal cutter blade together with means for pivotably mounting the blade to the machine, and with an electrically powered motor unit coupled to the blade for actuation of the cutter unit.

The terms and expressions which have been used are used as terms of description and not of limitation, and there is no intention in the use of such terms and expressions of excluding any equivalents of any of the features shown or described, or portions thereof and it is recognized that various modifications are possible within the scope of the invention claimed.

We claim:

1. In a converter mechanism for producing generally low density pad-like cushioning dunnage product in strip form from flexible sheet-like stock material, such as for instance paper, and emitting it through an exit opening in said mechanism, and which includes a cutter means for cutting the pad-like dunnage product into selected lengths, said cutter means comprising a movable blade member for engaging the produced dunnage product and cutting it into selected lengths, and power means for actuating said cutter means, said power means comprising an electrically energizable motor unit consisting of a solenoid including a reciprocal plunger portion, and means including a rotatable shaft to which is attached said plunger portion and said blade member coupling said motor unit to said blade member for causing movement of the latter, said blade member being mounted for pivotal movement in a generally vertical plane and from a lower gravity induced inactive position in said mechanism to an upwardly swung operative cutting position with respect to associated dunnage product produced and emitted by said mechanism, and upon energization of said motor unit, said mechanism also including an electric drive motor for actuating said mechanism to produce the dunnage product from the stock material and emitting the product through said exit opening, and motor control means including a switch operatively wired to said drive motor and so positioned in said mechanism so as to be engaged and actuated by said cutter means in said gravity induced inactive position of said blade member so as to permit energization of said drive motor only when said blade member is in said gravity induced inactive position, and upon upward pivotal movement of said blade member from said gravity induced inactive position toward said operative cutting position and away from engaged relation with said switch, said switch automatically opening and thus automatically deactivating said drive motor, so that cutting of the produced dunnage product by said cutter means can occur only when the dunnage product is stationary relative to said mechanism.

2. A mechanism in accordance with claim 1 wherein said blade member comprises a generally arcuate shaped in elevation blade member mounted adjacent one end thereof for said pivotal movement from said lower inactive position to said operative cutting position in said generally vertical plane.

3. A mechanism in accordance with claim 2 wherein said cutter means includes an arcuate shaped, in elevation, mounting bar for said blade member, the latter being removably secured to said bar, and having a cutting edge extending laterally of a complementary edge of said bar, said bar being secured to said shaft adjacent one end of said bar and thus pivotally mounting said blade member in said mechanism, and bumper means normally mounted in spaced relation to said mounting bar and adapted for engagement therewith to limit the upward pivotal movement of said bar and attached blade in said plane, and means for adjusting the positon of said bumper means relative to said mounting bar and attached blade whereby the range of upward swinging movement of said bar and attached blade in said plane can be varied.

4. A mechanism in accordance with claim 2 wherein cutter means is mounted on said mechanism adjacent said exit opening through which the produced pad-like product is adapted to be emitted, and wherein said arcuate blade has its convex edge as its leading edge during its upward swinging movement from said inactive position and wherein in the latter position it is disposed generally below the lowermost defining surface of said exit opening, and when moved to said cutting position it is disposed generally above said exit opening, said cutter means also including a generally linear cutter blade member mounted on said mechanism above said exit opening, and adapted for coaction with said pivotal blade member upon said pivotal movement of said pivotal blade member for causing said cutting of the dunnage product into selected lengths responsive to energization of said solenoid.

5. A mechanism in accordance with claim 2 wherein the mechanism comprises a supporting frame, and including means for mounting said cutter blade member on said mechanism frame, said mounting means comprising bracket means supported on said mechanism frame and rotatably mounting said shaft thereon, said shaft generally adjacent one end thereof being coupled to the reciprocal plunger portion of said solenoid whereby actuation of said plunger portion in one direction causes said rotation of said shaft and thus said upward pivotal movement of said blade member.

6. A mechanism in accordance with claim 2 wherein said cutter means also includes an inverted generally U-shaped bracket disposed in partially encompassing relationship to said exit opening, and a generally linear cutter blade mounted on said inverted bracket and adapted for coaction with said pivotal cutter blade member for causing severing of the dunnage product into selected lengths upon actuation of said solenoid.

7. A mechanism in accordance with claim 6, including a bumper bracket mounted adjacent said inverted U-shaped bracket, said bumper bracket mounting adjustable bumper means thereon in generally depending relationship with respect thereto, said cutter means including a relatively heavy mounting bar for said blade member, the latter being removably secured to said bar and having a cutting edge extending laterally of a complementary edge of said bar, said bar and attached blade member being pivoted in said mechanism by said shaft for upward pivotal swinging movement of said bar and attached cutting blade upon said energization of said solenoid, said bumper means being adapted for limiting said upward pivotal movement of said cutter means by engagement with said bar of said cutter means.

8. A mechanism in accordance with claim 7 wherein said bumper bracket includes a top wall which is obliquely oriented with respect to the horizontal, said bumper means being mounted on said obliquely oriented wall whereby it depends from said obliquely oriented wall in obliquely depending position with respect to the vertical.

9. A mechanism in accordance with claim 1 adapted to produce the pad-like cushioning dunnage product from sheet-like stock material in multi-ply roll form, said mechanism further comprising a supporting frame, and stitching means on said frame adapted to receive the sheet-like stock material therein and operable to connect lateral edge portions of the same into a pad-like cushioning dunnage product, said drive motor being coupled to said stitching means for actuating the latter, a longitudinally converging means mounted on said frame upstream from said stitching means and including a widened entrance mouth portion and operable for causing inward rolling of the lateral edge portions of the sheet-like stock material into generally spiral-like form prior to entry of the sheet-like stock material into said stitching means, said stitching means being operable to pull the sheet-like stock material from the stock roll through said converging means and to connect the formed rolled lateral edge portions together and emit the finished pad-like dunnage product through said exit opening in said mechanism, said cutter means being disposed adjacent said exit opening downstream from said stitching means and operable for severing the continuous produced strip of pad-like dunnage material into selected lengths upon said energization of said solenoid thereof.

10. A cutter unit adapted for mounting on a frame of a dunnage producing mechanism which is adapted to produce a relatively low density pad-like cushioning dunnage product from sheet-like stock material, such as, for instance, paper, and which mechanism includes an electric drive motor for actuating the mechanism to produce the dunnage product from the stock material and emit the product from the mechanism through a product exit opening in the mechanism, said cutter unit comprising a pivotal elongated mounting bar and a cutter blade secured to said bar, and means including a rotatable shaft to which is attached said mounting bar and blade, for pivoting said mounting bar and blade adjacent one end thereof to the frame of an associated dunnage producing mechanism, for pivotal movement in a generally vertical plane of said bar and blade from a lower gravity induced inactive position upwardly to an operative cutting position, and an electrically powered linearly reciprocal motor unit consisting of a solenoid including a reciprocal plunger portion which is coupled to said rotatable shaft and thus to said bar and blade, adapted for mounting on the mechanism for pivotal actuation of the bar and blade relative to the mechanism frame for causing severing of the produced dunnage product into selected length upon said upward movement of said bar and blade to said cutting position, and means for controlling the actuation of said solenoid and the associated mechanism drive motor, the last mentioned means including a switch adapted to be operatively wired to the mechanism drive motor and being engageable and actuated by said bar and blade in said gravity induced inactive position of the latter for activation of said switch so as to permit energization of the mechanism drive motor only when said bar and blade are in said gravity induced inactive position, and upon upward pivotal movement of said bar and blade from said gravity induced inactive position toward said cutting position, said switch automatically opening and being deactivated thus being operable to automatically deactivate the mechanism drive motor so that cutting of the produced dunnage product by said cutter unit can occur only when the dunnage product is stationary relative to the mechanism frame.

11. A cutter unit in accordance with claim 10 wherein said bar and blade are both of generally arcuate configuration in elevation, with the leading edge of said cutter blade in said upward movement thereof being convex, and means for removably securing said bar and blade to said shaft.

12. A cutter unit in accordance with claim 11 wherein said shaft includes a lever secured thereto and projecting laterally thereof, and means movably coupling the distal end of said lever to the reciprocal plunger portion of said solenoid for rotating said shaft responsive to predetermined reciprocal movement of said solenoid.

13. A cutter unit in accordance with claim 11 wherein said cutter unit also includes a generally linear stationary cutter blade mounted on a bracket adapted to partially encompass the product exit opening of an associated dunnage producing mechanism and adapted to mount said stationary cutter blade above the exit opening therein, said stationary cutter blade and said pivotal cutter blade adapted to coact with one another during upward pivotal movement of said pivotal bar and blade and relative to said stationary cutter blade to accomplish severing of the dunnage product to selected length.

* * * * *